US005562229A

United States Patent [19]

Callahan

[11] Patent Number: 5,562,229

[45] Date of Patent: Oct. 8, 1996

[54] DECORATIVE RECEPTACLE WITH REMOVABLE COVER

[75] Inventor: Edward Callahan, Yardley, Pa.

[73] Assignee: Abernathy, Bernstein & Callahan, Inc., Trenton, N.J.

[21] Appl. No.: 449,815

[22] Filed: May 24, 1995

[51] Int. Cl.[6] ..... B65D 3/00; B65D 25/34; B65D 65/02

[52] U.S. Cl. ..... 220/460; 220/625; 220/908; 150/154

[58] Field of Search ..... 150/154, 103–105; 220/908, 410, 460, 484, 625, 630, 910

[56] References Cited

U.S. PATENT DOCUMENTS

| | | | |
|---|---|---|---|
| 1,453,824 | 5/1923 | Bauer | 220/625 |
| 2,779,373 | 1/1957 | Koepke | 150/105 |
| 3,115,986 | 12/1963 | Groff | 220/410 X |
| 3,179,286 | 4/1965 | Morceau | 220/460 X |
| 3,185,339 | 5/1965 | Fleming | 220/908 X |
| 3,566,414 | 3/1971 | Basner | 150/154 X |
| 3,984,941 | 10/1976 | Chetta, Jr. | 220/908 X |
| 4,065,020 | 12/1977 | Carson | 220/484 |
| 4,651,791 | 3/1987 | Evenson | 220/625 |
| 4,961,514 | 10/1990 | Palmer | 220/908 X |
| 5,165,567 | 11/1992 | Richardson et al. | 150/154 X |
| 5,318,821 | 6/1994 | Bradley, Jr. | 220/460 X |
| 5,325,986 | 7/1994 | Richardson et al. | 150/154 X |

FOREIGN PATENT DOCUMENTS

| | | | |
|---|---|---|---|
| 1104887 | 4/1961 | Germany | 220/625 |
| 686965 | 2/1953 | United Kingdom | 150/103 |
| 1562464 | 3/1980 | United Kingdom | 220/910 |
| 2176463 | 12/1986 | United Kingdom | 220/908 |

*Primary Examiner*—Sue A. Weaver
*Attorney, Agent, or Firm*—Adams & Wilks

[57] ABSTRACT

A decorative receptacle, such as a wastebasket, comprises a two-piece receptacle body formed of a tubular sidewall member and a base member releasably connected to the bottom of the tubular member, and a decorative cover removably disposed on the receptacle body and encircling the tubular sidewall member. The tubular and base members are each one-piece, molded structures. The base member has an array of upstanding pins on its upper surface which frictionally fit in corresponding openings of the tubular sidewall member to releasably connect the two members together to form the receptacle body. The decorative cover has a tubular configuration and fits slidably over the outer surface of the tubular sidewall member. The opposite ends of the decorative cover are sandwiched between flanges at the top and bottom of the receptacle body. Upon manual detachment of the base member from the tubular sidewall member, the decorative cover can be slid axially off of the tubular member and removed for cleaning, repair or replacement.

19 Claims, 2 Drawing Sheets

DECORATIVE RECEPTACLE WITH REMOVABLE COVER

BACKGROUND OF THE INVENTION

1. Field of the Invention

The present invention relates generally to a decorative receptacle, such as a wastebasket, storage receptacle and the like, and more particularly to a decorative receptacle comprised of a rigid two-part receptacle body and a decorative cover removably disposed over the receptacle body.

2. Background Information

Receptacles have long been used as wastebaskets, storage containers and the like and have been provided in many different construction designs. However, such prior art receptacles have been relatively difficult to manufacture and to assemble and disassemble. Furthermore, prior art receptacles of the type described often do not present a pleasing, aesthetic appearance and cannot be easily modified by the user to adopt a decorative appearance consistent with a desired decor or color scheme.

In recent years, it has become popular to decorate bathrooms, playrooms and offices with design-coordinated accessories, such as wastebaskets, storage containers and other receptacles. For example, it has become fashionable to decorate bathroom accessories with fabric to match selected designs in tiles and window and shower curtains.

One known type of decorative receptacle comprises a one-piece plastic container which removably fits within a rigid decorative enclosure having bottom and side walls. The rigid decorative enclosure typically comprises a decorative fabric permanently bonded to a cardboard support structure, which precludes removal of the decorative fabric from the support structure for cleaning, repair or replacement. Such a decorative receptacle is costly and time-consuming to manufacture and assemble, particularly the decorative enclosure.

Other decorative receptacles have been proposed which suffer the disadvantage that tools and/or separate fastening elements are required during assembly and disassembly thereof. This results in increased manufacturing costs and time-consuming assembly and disassembly.

SUMMARY OF THE INVENTION

It is a principal object of the present invention to provide a decorative receptacle which overcomes the aforedescribed disadvantages of conventional decorative receptacles.

It is another object of the present invention to provide a decorative receptacle which can be easily manufactured in large quantities at low cost.

It is another object of the present invention to provide a decorative receptacle which can be quickly and easily assembled and disassembled with minimal effort and without the use of any tools.

It is yet another object of the present invention to provide a decorative receptacle having a decorative cover which can be easily removed for cleaning, repair or replacement.

The foregoing and other objects of the present invention are carried out by a decorative receptacle comprising a two-piece receptacle body formed of a tubular sidewall member and a base member releasably connected to the bottom of the tubular member, and a decorative cover removably disposed on the receptacle body and encircling the tubular sidewall member. The tubular and base members are each one-piece, molded plastic structures. The base member has an array of upstanding pins on its upper surface which frictionally fit in corresponding openings of the tubular sidewall member to releasably connect the two members together to form the receptacle body. The decorative cover has a tubular configuration and fits slidably over the outer surface of the tubular sidewall member. The opposite ends of the decorative cover are sandwiched between flanges at the top and bottom of the receptacle body. Upon manual detachment of the base member from the tubular sidewall member, the decorative cover can be slid axially off of the tubular member and removed for cleaning, repair or replacement.

BRIEF DESCRIPTION OF THE DRAWINGS

The foregoing summary, as well as the following detailed description of a preferred embodiment of the invention, will be better understood when read in conjunction with the accompanying drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE PREFERRED EMBODIMENT

While this invention is susceptible of embodiments in many different forms, this specification and the accompanying drawings disclose only one form as an example of the use of the invention. The invention is not intended to be limited to the embodiment so described, and the scope of the invention will be pointed out in the appended claims.

Figure 1:
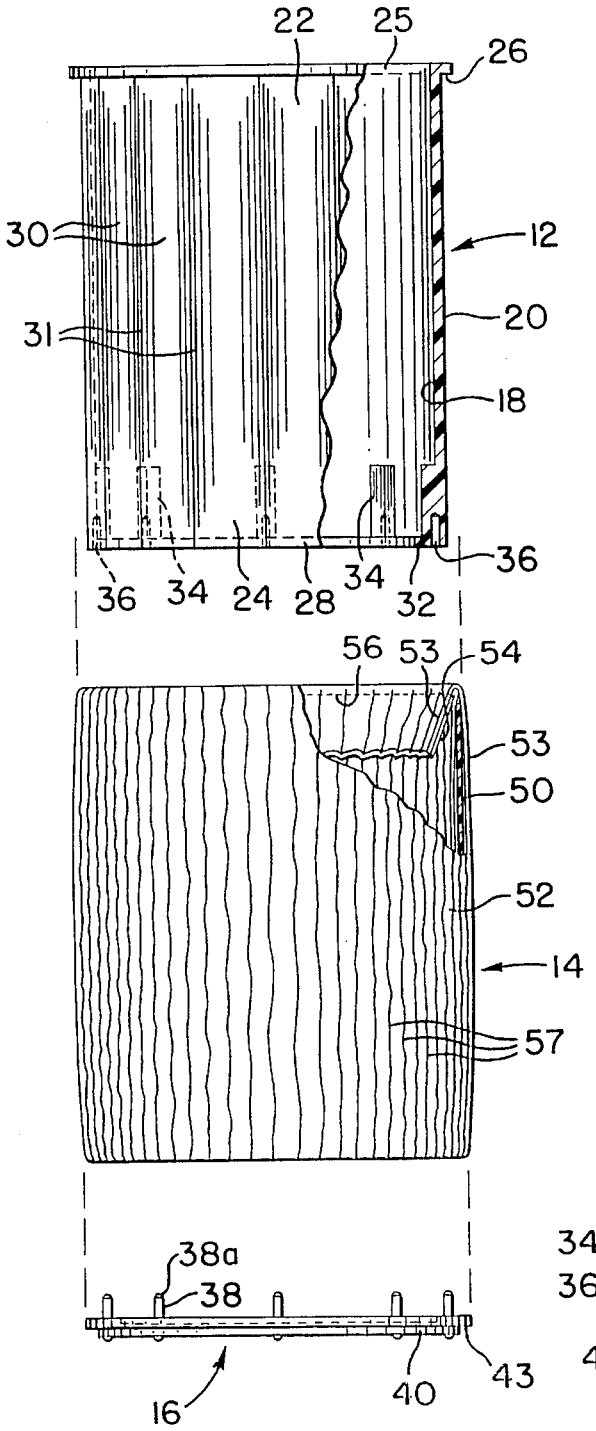
FIG. 1 is an exploded front view, partly in section, of a decorative receptacle according to the present invention.
Figure 2:
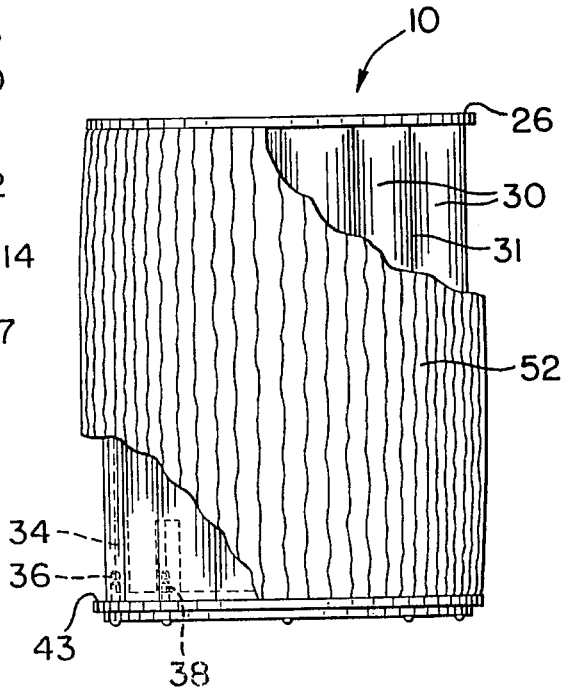
FIG. 2 is a front elevational view, partly in section, of the decorative receptacle of FIG. 1 in an assembled state.

Referring now to the drawings in detail, wherein like numerals are used to indicate like elements throughout, there is shown in FIGS. 1–5 an embodiment of a decorative receptacle, generally designated at 10, according to the present invention. As shown in FIGS. 1–2, the decorative receptacle 10 comprises a tubular sidewall member 12 and a base member 16 detachably connected to the bottom of the tubular sidewall member 12 to constitute a two-part receptacle body. A decorative cover 14 is removably disposed over the receptacle body and encircles the tubular sidewall member 12. During use, the decorative receptacle 10 stands upright on a floor or the like, as shown in FIG. 2.

The tubular sidewall member 12 is of rigid, unitary construction and has inner and outer peripheral surfaces 18 and 20, respectively, an open upper end 22, and an open lower end 24. The open upper end 22 terminates in a rim portion 25, and the open lower end 24 terminates in a rim portion 28. The open upper end 22 defines an opening for receiving objects in the receptacle, such as, for example, waste paper and other refuse when the decorative receptacle 10 is used as a wastebasket. The outer peripheral surface 20 has a plurality of circumferentially spaced-apart flat portions or flats 30 which extend lengthwise from the upper rim portion 25 to the lower rim portion 28 and which are separated from one another by junction portions 31. As further described below, the flats 30 and junctions 31 provide the outer peripheral surface 20 with a non-circular shape, which assists in preventing angular displacement of the decorative cover 14 about the tubular member 12. On the other hand, the inner peripheral surface 18 preferably has a circular shape.

At the upper end 22 of the tubular sidewall member 12, the rim portion 25 terminates in an annular flange 26 which extends radially outwardly a short distance from the outer peripheral surface 20. As described below, the annular flange 26 defines an abutment surface for the decorative cover 14 and is dimensioned to limit the extent of axial insertion of the tubular sidewall member 12 into the decorative cover 14.

Figure 3:
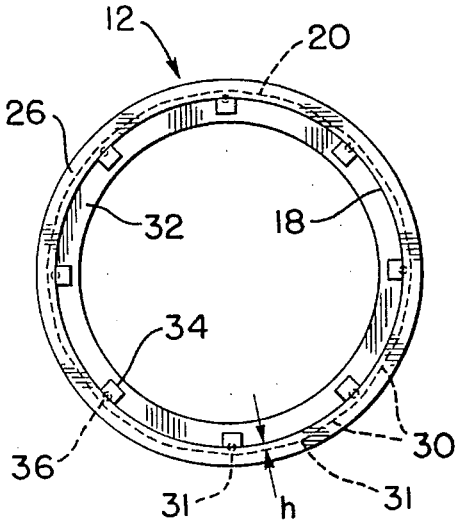
FIG. 3 is a top plan view of the tubular sidewall member.

FIG. 3 is a top plan view of the tubular sidewall member 12 shown in FIG. 1. The rim portion 28 at the lower end of the tubular member 12 terminates in an annular flange 32 which extends radially inwardly a short distance from the inner peripheral surface 18. A plurality of ribs or pedestals 34 are disposed at equally-spaced intervals about the circumference of the annular flange 32 and extend axially upwardly along the inner peripheral surface 18 of the tubular member 12. The ribs 34 are affixed at their lower ends to the annular flange 32 and are affixed along one of their sides to the inner peripheral surface 18 of the tubular member 12. Each rib 34 has an axial opening or blind bore 36 dimensioned to receive therein with a friction fit a connecting member or pin 38 of the base member 16 to enable removable attachment of the base member 16 to the lower end 28 of the tubular sidewall member 12, as described in more detail below.

As shown in FIG. 3, the ribs 34 have a generally square cross-sectional shape. However, as will be understood by those skilled in the art, the ribs 34 may have cross-sectional shapes other than square, such as triangular or semi-circular, or other shapes. As best shown in FIGS. 1 and 2, the ribs 34 extend axially upwardly a substantial distance form the annular flange 32 and rigidify and strengthen the lower end of the tubular member 12 in the region of the blind bores 36. Each blind bore 36 extends axially through the annular flange 32 to a distance about one-third the length of the ribs 34. By such a construction, the ribs 34 reinforce the lower end of the tubular sidewall member 12 and strengthen the regions thereof at which the blind bores 36 are formed.

Referring again to FIG. 3, the peripheral wall of the tubular sidewall member 12, between the inner and outer peripheral surfaces 18, 20, has a varying thickness "h". The peripheral wall thickness "h" is greatest at the junction portions 31 between adjacent flats 30, including the junction portions at which the ribs 34 are located. The increased wall thickness at these locations is needed to accommodate the blind bores 36, which are formed, preferably by drilling, at the interface between the ribs 34 and the inner peripheral surface 18. The thicker wall portions at these locations are also needed to withstand the high concentrated stresses developed during insertion of the pins 38 of the base member 16 into the blind bores 36 during attachment of the base member 16 to the tubular sidewall member 12.

In accordance with the preferred embodiment of the invention, the entire tubular sidewall member 12, including the upper and lower annular flanges 26 and 32 and the ribs 34, is formed as a one-piece structure by injection molding. The tubular member 12 is formed of moldable plastic material, such as styrene, polyvinyl chloride or other hard plastic materials. By forming the tubular sidewall member 12 in one piece, manufacture and assembly of the receptacle body is greatly facilitated as compared, for example, to separately forming the ribs 34 and attaching them to the inner surface 18 and the annular flange 32 by adhesive or the like.

In the present embodiment, the tubular sidewall member 12 is generally circular in cross-section. However, it is understood by those skilled in the art that the tubular sidewall member may have a cross-sectional shape other than circular, such as rectangular, elliptical, etc.

Figure 4:
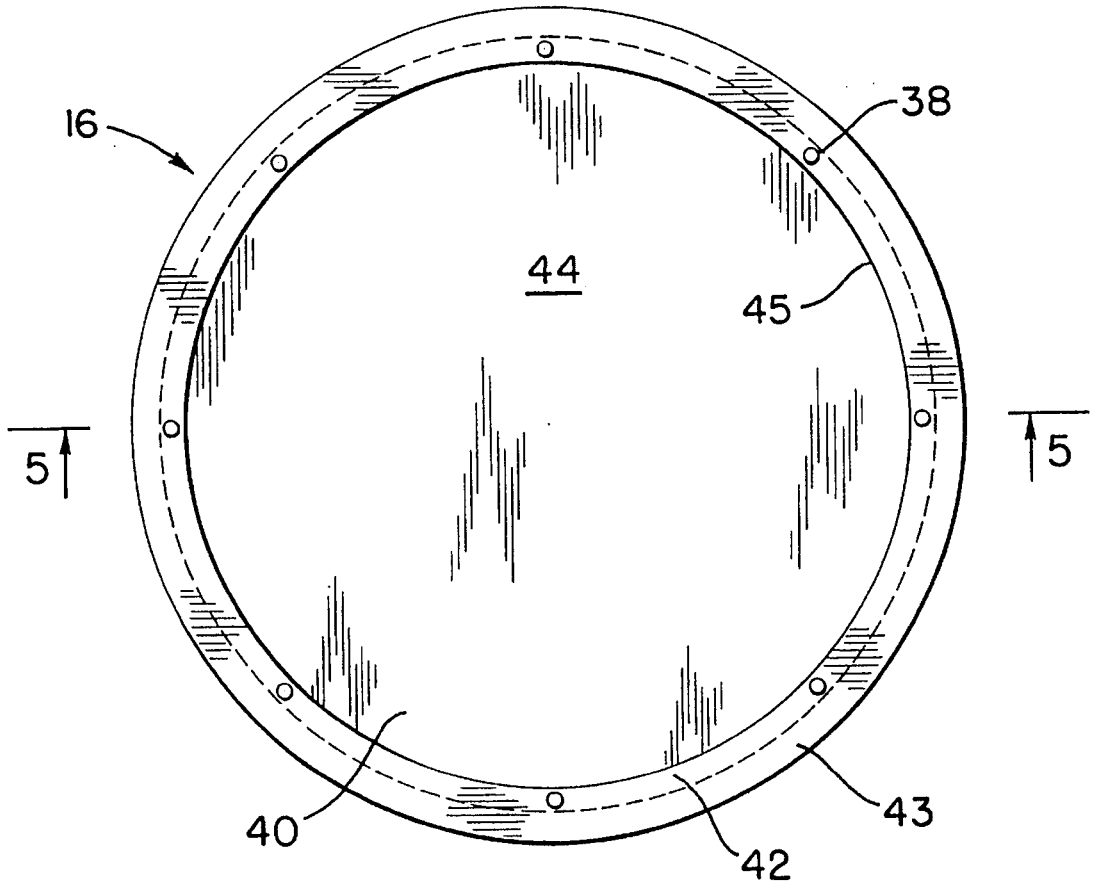
FIG. 4 is a top plan view of the base member.
Figure 5:
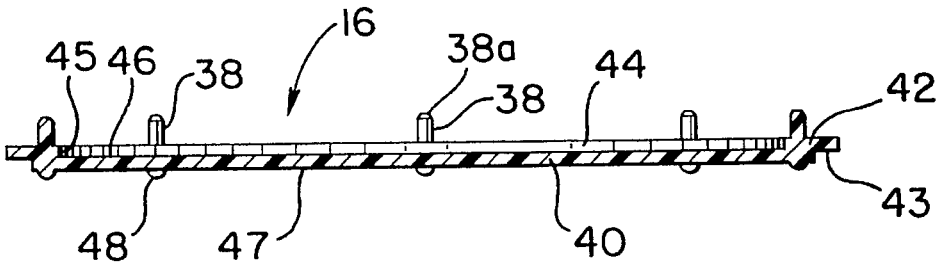
FIG. 5 is a cross-sectional view of the base member taken along line 5—5 in FIG. 4.

The base member 16 is shown in FIGS. 4 and 5, FIG. 4 being a top plan view thereof and FIG. 5 being a cross-sectional view thereof taken along line 5—5 in FIG. 4. The base member 16 has a circular plate portion 40, and an annular plate portion 42 connected to the upper surface of the plate portion 40 and extending circumferentially around the periphery thereof. The annular plate portion 42 extends radially outwardly a short distance from the upper surface of the plate portion 40 to define an annular flange 43. As described below, the annular flange 43 defines an abutment surface for the decorative cover 14 and coacts with the annular flange 26 of the tubular sidewall member 12 to sandwich therebetween the decorative cover 14. By such a construction, the base member 16 is provided with a circular recessed portion 44 defined by the inner periphery 45 of the annular plate portion 42 and the upper surface 46 of the plate portion 40.

A plurality of connecting members or pins 38 are disposed at equally-spaced intervals about the circumference of the annular plate portion 42 and extend axially upwardly therefrom. The connecting members or pins 38 are positioned on the base member 16 to align with respective ones of the openings or blind bores 36 of the tubular member 12 to enable the pins 38 to be inserted into the bores 36 to removably attach the base member 16 to the tubular sidewall member 12. In this embodiment, both the pins 38 and the bores 36 are circumferentially spaced apart at equal intervals, though the spacing may be at unequal intervals if desired. The connecting members or pins 38 have a diameter slightly greater than the diameter of the blind bores 36, thereby ensuring a tight frictional fit between each pin and its respective bore when the base member 16 is removably attached to the tubular sidewall member 12. The pins 38 are preferably provided with a tapered leading end 38a to facilitate insertion thereof into the blind bores 36. On the bottom surface 47 of the plate portion 40, at locations beneath the pins 38, are provided a plurality of rounded protuberances or knobs 48 for supporting the decorative receptacle 10 on a floor or other surface.

In the present embodiment, there are eight blind bores 36 and eight corresponding pins 38. However, it is understood by those skilled in the art that any other suitable number of bores and pins may be employed to provide a removable but secure connection between the tubular sidewall member 12 and the base member 16. Also, though the bores 36 and the pins 38 are shown as having circular cross sections, they may have other cross-sectional shapes, such as square, rectangular, polygonal, etc.

In accordance with the preferred embodiment of the invention, the entire base member 16, including the connecting members or pins 38, is formed as a one-piece structure by injection molding. The base member 16 is formed of moldable plastic material, such as styrene, polyvinyl chloride or other hard plastic materials. By molding the base member 16 in one piece, manufacture and assembly of the receptacle body is greatly facilitated. The tubular sidewall member 12 and the base member 16 are both one-piece structures, which can be quickly and easily assembled together, without need of any tools and without need of separate fastening elements, adhesive, etc., to form a receptacle body having a closed bottom end.

Referring again to FIGS. 1–2, the removable decorative cover 14 is in the form of a tubular body comprised of a tubular hollow form 50 over which is sewn a decorative covering 52. The hollow form 50 comprises, in this embodiment, a generally cylindrical hollow form having opposite open ends and is preferably formed of a flexible or semi-flexible material which will not be damaged upon contact with water. For example, the hollow form 50 may be formed of plastic material. The decorative covering 52 may be formed of textile fabric, such as woven cloth, paper, leather or other suitable decorative materials. In the present embodiment, the decorative covering 52 is comprised of a piece of textile fabric folded over the lower end of the hollow form 50, with an outer ply 53 thereof extending upwardly over the outer surface of the hollow form and an inner ply 54 thereof extending upwardly over the inner surface of the hollow form. At the upper end of the hollow form 50, the outer ply 53 is folded over the rim of the hollow form, overlapped with the inner ply 54 and stitched to the inner ply 54 by stitching 56. By stitching together the outer and inner plies 53,54 on the inside of the hollow form 50, the two plies 53,54 hang downwardly from the stitch line 56 into the interior of the tubular body and increase the frictional engagement between the decorative cover 14 and the tubular sidewall member 12 to restrain relative movement between the two parts.

In the disclosed embodiment, the decorative fabric 52 is gathered together in overlapping relation at various points about the circumference of the hollow form 50 to form a series of pleats 57 which extend lengthwise of the decorative cover 14. The decorative fabric 52 may thus be quickly and simply secured to the hollow form 50 by a single line of stitching 56, which is concealed from view after insertion of the tubular sidewall member 12 into the decorative cover 14.

In accordance with the present invention, the decorative fabric 52 may be easily removed from the hollow form 50 and replaced by another one of different design, color or pattern. To remove the decorative fabric 52 from the hollow form 50, the stitching 56 is cut, thereby separating the outer and inner plies 53, 54, which can then be unfolded and removed from the hollow form 50 for washing, replacement, etc. The fabric 52 may be provided with any desired decorative design or pattern, or may be of solid color. For example, if the decorative receptacle 10 is to be used as a wastebasket in a bathroom, a fabric color and/or design may be selected which coordinates with the color and/or design of bathroom curtains, towels or other accessories. If it is desired to change the bathroom decor, the decorative cover 14 may easily be replaced with a new decorative cover having a different color and/or design.

Assembly and disassembly of the decorative receptacle 10 according to the present embodiment will be explained below with reference to FIGS. 1–2. To assemble the receptacle 10, the lower end 24 of the tubular sidewall member 12 is inserted axially into the open upper end of the decorative cover 14, and the tubular member 12 is inserted lengthwise into the decorative cover 14 until the upper annular flange 26 of the tubular member abuts the upper end of the decorative cover 14. In that state, the lower ends of the members 12 and 14 are coextensive and the bottom face of the lower rim portion 28 of the tubular member 12 is freely exposed. The base member 16 is then releasably attached to the tubular sidewall member 12 by aligning the connecting members 38 with the blind bores 36 and moving the members 12 and 16 towards each other to engage the connecting members 38 in the bores 36. By suitably selecting the sizes of the blind bores 36 and the connecting members 38, the connecting members engage in the bores with a tight frictional fit, thereby releasably connecting the base member 16 to the tubular sidewall member 12.

In the assembled state shown in FIG. 2, the decorative cover 14 is sandwiched between the upper and lower annular flanges 26 and 43 of the tubular sidewall member 12 and the base member 16, respectively. In the disclosed embodiment, the outer diameter of the decorative cover 14 approximates that of the annular flanges 26 and 43 so that the decorative receptacle 10 has a generally cylindrical shape. The provision of the junctions 31 projecting outwardly on the outer peripheral surface 20 of the tubular sidewall member 12 helps provide a snug fit between the tubular member 12 and the decorative cover 14, thereby restraining angular displacement of the decorative cover about the tubular member. Further restrainment is provided by the two plies 53, 54 of the fabric covering 52, which are wedgingly compressed between the tubular sidewall member 12 and the decorative cover 14 upon insertion of the tubular member into the decorative cover. By such a construction, the decorative cover 14 is prevented from undergoing axial displacement by the upper and lower flanges 26 and 43, between which the decorative cover is sandwiched, and is restrained from undergoing angular displacement about the tubular member 12 by the frictional resistance provided by the non-circular configuration of the outer surface 20 and the overlapping fabric plies 53, 54 sandwiched between the tubular member 12 and the decorative cover 14.

In order to disassemble the decorative receptacle 10 and remove the decorative cover 14, the base member 16 is detached from the tubular sidewall member 12 simply by applying downward pressure to the base member 16 from inside the tubular member 12 to overcome the frictional Connection between the connecting members 38 and the blind bores 36. In view of the relative dimensioning of the connecting members 38 and the bores 36, removal of the base member 16 can easily be accomplished by lightly tapping the base member 16 with one's hand to disengage the connecting members 38 from the bores 36. Upon removal of the base member 16, the decorative cover 14 can be slid axially off of the tubular sidewall member 12 for washing, repair or replacement with a new decorative cover.

It will understood from the above description that the decorative receptacle 10 comprises three detachably connectable parts: the tubular sidewall member 12, the decorative cover 14 and the base member 16. These parts can be easily assembled and disassembled without need of any tools, adhesives, separate fastening elements or the like. Moreover, the tubular member 12 and the base member 16 are each preferably molded one-piece structures which themselves-require no assembly.

From the foregoing, it can be appreciated that the decorative receptacle 10 according to the present invention can be easily manufactured at low cost and can be quickly and simply assembled and disassembled without use of tools or adhesives and without requiring additional parts, such as fastening elements and the like. It will also be appreciated that the decorative cover may be easily removed for washing, repair or exchange with another one of different design, thereby enhancing the versatility of the decorative receptacle and enabling it to be easily color coordinated with different decors and environments.

It will be appreciated by those skilled in the art that obvious changes and modifications may be made to the presently preferred embodiment of the invention described above without departing from the broad inventive concept thereof. It is understood, therefore, that this invention is not limited to the presently preferred embodiment disclosed herein, but is intended to cover all obvious changes and modifications which fall within the scope and spirit of the invention as defined by the appended claims.

What is claimed is:

1. A decorative receptacle comprising: a rigid tubular member having an outer peripheral surface, an inner peripheral surface, upper and lower open ends terminating in respective rim portions, an upper annular flange extending radially outwardly from the upper rim portion, a lower annular flange extending radially inwardly from the lower rim portion, and a plurality of ribs disposed about the circumference of the lower annular flange and extending axially upwardly along the inner peripheral surface of the tubular member; a base member detachably connected to the lower open end of the tubular member to define therewith a receptacle body; and a tubular decorative cover having upper and lower open ends and being removably disposed on the receptacle body and encircling the outer peripheral surface of the tubular member, the decorative cover being sandwiched between the base member and the upper end of the tubular member and being slidably removable from the receptacle body upon detachment of the base member from the tubular member.

2. A decorative receptacle as claimed in claim 1; wherein the tubular member, including the upper and lower annular flanges and the ribs, is of unitary construction.

3. A decorative receptacle as claimed in claim 1; wherein the base member comprises a first plate portion having upper and lower surfaces, a second plate portion connected to the upper surface of the first plate portion and extending radially outwardly thereof to define an annular flange, and a plurality of connecting members disposed about the circumference of the second plate portion and extending axially upwardly therefrom.

4. A decorative receptacle as claimed in claim 3; wherein the base member, including the first and second plate portions and the connecting members, is of unitary one-piece construction.

5. A decorative receptacle as claimed in claim 3; wherein at least some of the ribs of the tubular member have an axial opening therein which opens toward the base member for removably receiving respective ones of the connecting members of the base member.

6. A decorative receptacle as claimed in claim 5; wherein each of the axial openings is dimensioned to receive one of the connecting members with a friction fit.

7. A decorative receptacle as claimed in claim 1; wherein the tubular member outer peripheral surface has around the circumference thereof a plurality of spaced-apart flat portions extending lengthwise from the upper rim portion to the lower rim portion.

8. A decorative receptacle comprising: a rigid tubular member having an outer peripheral surface, an inner peripheral surface, and upper and lower open ends terminating in respective rim portions; a base member detachably connected to the lower open end of the tubular member to define therewith a receptacle body; and a tubular decorative cover having upper and lower open ends and being removably disposed on the receptacle body and encircling the outer peripheral surface of the tubular member the decorative cover being sandwiched between the base member and the upper end of the tubular member and being slidably removable from the receptacle body upon detachment of the base member from the tubular member, the decorative cover comprising a tubular hollow form having inner and outer surfaces and upper and lower open ends, and a decorative covering disposed over the tubular hollow form.

9. A decorative receptacle as claimed in claim 8; wherein the decorative covering comprises a piece of textile fabric folded upwardly over the lower end of the tubular hollow form to define an outer portion extending upwardly over the outer surface of the tubular hollow form and an inner portion extending upwardly over the inner surface of the tubular hollow form, the upper end of the outer portion being folded inwardly over the upper end of the tubular hollow form and overlapping the upper end of the inner portion.

10. A decorative receptacle as claimed in claim 9; wherein the overlapping inner and outer portions of the textile fabric are stitched together.

11. A decorative receptacle as claimed in claim 10; wherein the decorative covering has a plurality of pleats extending from the upper open end to the lower open end of the tubular hollow form.

12. A decorative receptacle comprising: a rigid tubular member having an outer peripheral surface, an inner peripheral surface, upper and lower open ends terminating in respective rim portions, an upper annular flange extending radially outwardly from the upper rim portion, a lower annular flange extending radially inwardly from the lower rim portion, and a plurality of rib portions disposed about the circumference of the lower annular flange and extending axially upwardly along the inner peripheral surface of the tubular member; a base member comprising a plate portion having upper and lower surfaces, and an annular plate portion connected to the upper surface of the plate portion; means for detachably connecting the base member to the lower open end of the tubular member; and a decorative cover removably disposed on the tubular member and encircling the outer peripheral surface thereof, the decorative cover being sandwiched between the base member and the upper end of the tubular member and being slidably removable from the tubular member upon detachment of the base member from the tubular member.

13. A decorative receptacle as claimed in claim 12; wherein the connecting means comprises a plurality of connecting members projecting upwardly about the circumference of the annular plate portion of the base member, and a plurality of axial openings extending axially into the rib portions of the tubular member for removably receiving therein respective ones of the connecting members.

14. A decorative receptacle as claimed in claim 13; wherein each of the axial openings is dimensioned to receive one of the connecting members with a friction fit.

15. A decorative receptacle as claimed in claim 14; wherein the base member is of unitary one-piece construction.

16. A decorative receptacle as claimed in claim 12; wherein the tubular member is of unitary one-piece construction.

17. A decorative receptacle as claimed in claim 12; wherein the outer peripheral surface of the tubular member has around the circumference thereof a plurality of spaced-apart flat portions extending lengthwise from the upper rim portion to the lower rim portion.

18. A decorative receptacle as claimed in claim 12; wherein the decorative cover comprises a tubular hollow form having opposed open ends, and a decorative covering disposed over the tubular hollow form.

19. A decorative receptacle as claimed in claim 12; wherein the tubular member and the base member each comprise injection molded one-piece structures.

* * * * *